United States Patent [19]

Neal et al.

[11] 4,351,517

[45] Sep. 28, 1982

[54] INSERT APPARATUS

[75] Inventors: Barry Neal, Malvern; Timothy M. Morris, Coatesville, both of Pa.

[73] Assignee: Mach-Neal, Inc., Malvern, Pa.

[21] Appl. No.: 167,955

[22] Filed: Jul. 14, 1980

[51] Int. Cl.[3] ..... B65H 39/00

[52] U.S. Cl. ..... 270/52; 225/100; 270/58

[58] Field of Search ..... 270/52, 53, 58, 41, 270/45; 225/100–101

[56] References Cited

U.S. PATENT DOCUMENTS

| | | | |
|---|---|---|---|
| 3,083,009 | 3/1960 | Barr et al. | 270/58 |
| 3,143,342 | 8/1964 | Pine | 270/52.5 |
| 3,178,170 | 4/1965 | Walck | 270/58 |
| 3,493,156 | 2/1970 | Absler | 225/100 |

FOREIGN PATENT DOCUMENTS

| | | | |
|---|---|---|---|
| 877824 | 8/1971 | Canada | 225/100 |

*Primary Examiner*—Richard J. Apley
*Assistant Examiner*—A. Heinz
*Attorney, Agent, or Firm*—Seidel, Gonda, Goldhammer & Panitch

[57] ABSTRACT

Preprinted cards, coupons, and the like are attached at spaced locations to a high speed moving web by an applicator drum. An assembly is moveable as a unit relative to a frame in a direction toward and away from the applicator drum. The assembly includes a feed roll for feeding a web in the form of a strip of connected cards, a motor for driving said feed roll, a burst wheel, a glue applicator, and a guide for guiding the strip of cards.

8 Claims, 8 Drawing Figures

FIG. 6
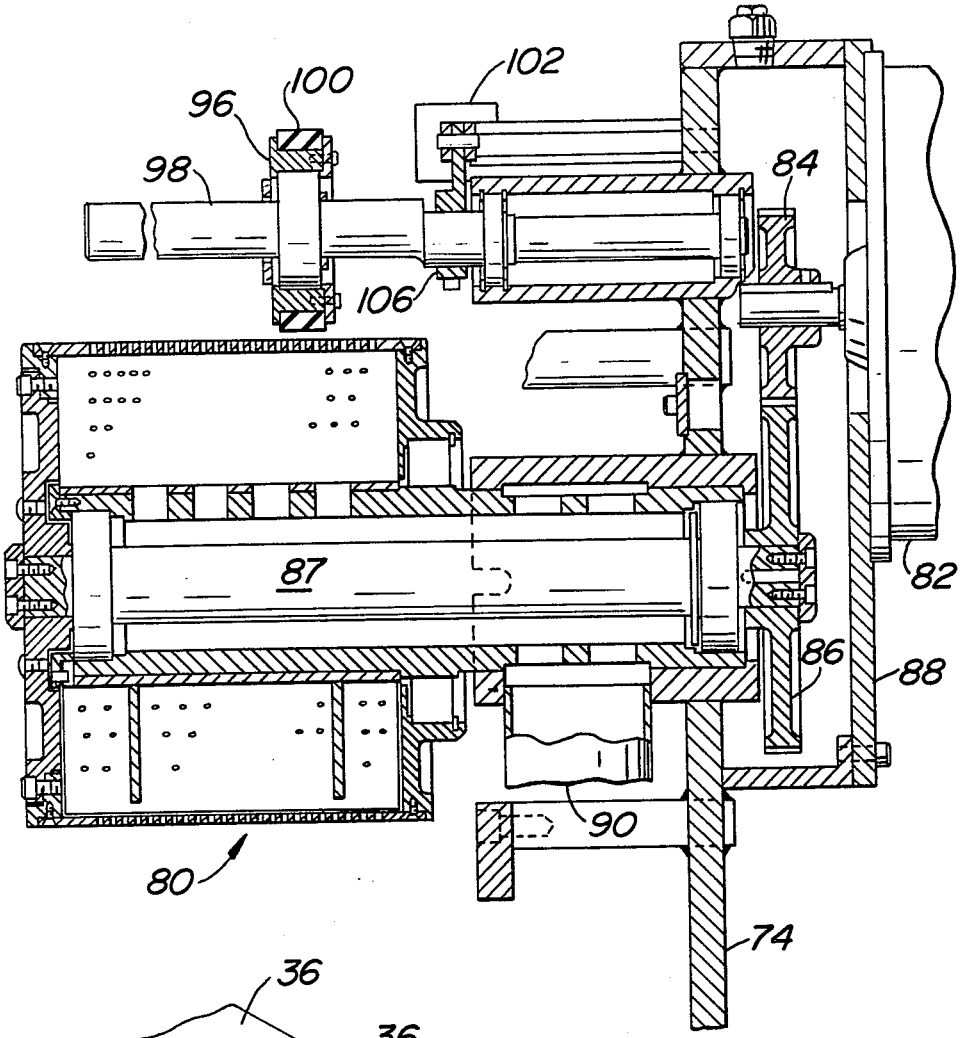
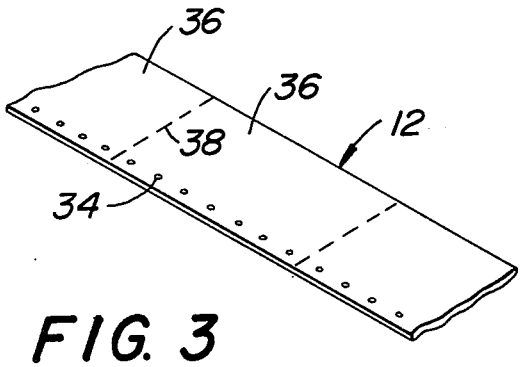
FIG. 3

FIG. 8
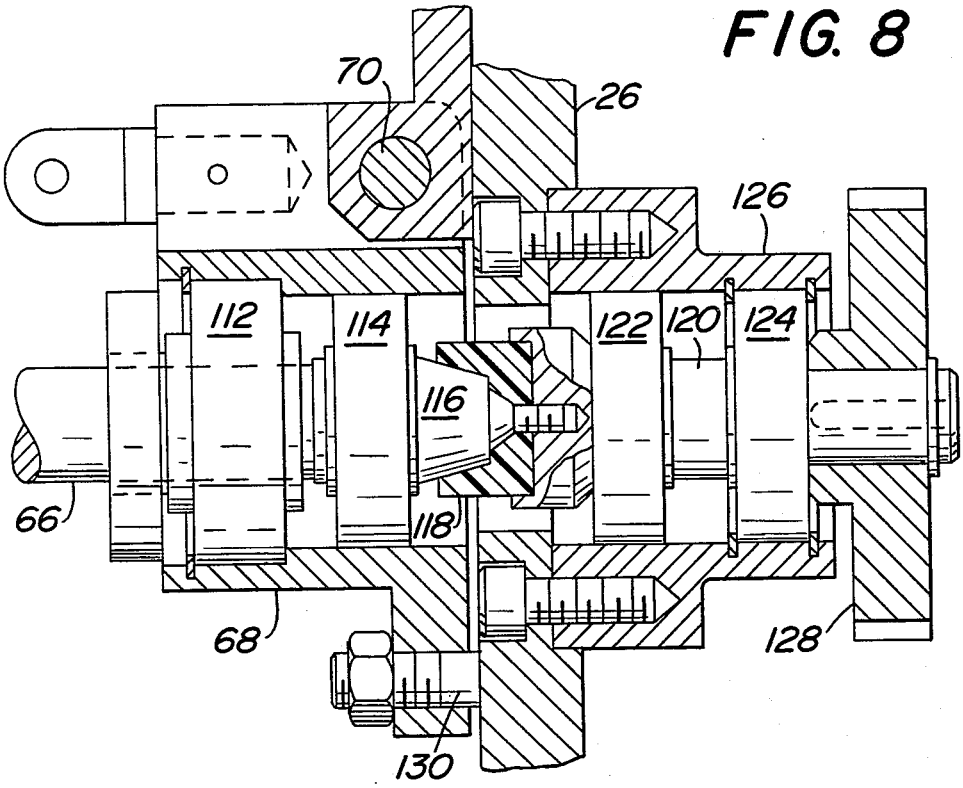
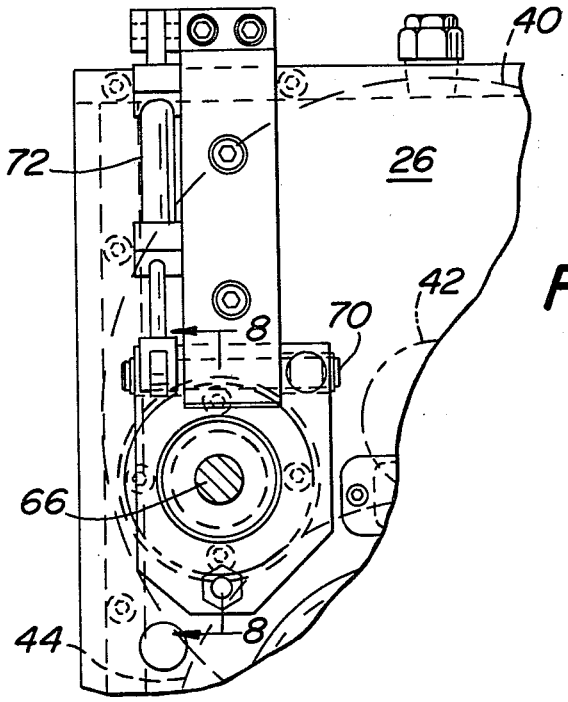
FIG. 7

INSERT APPARATUS

BACKGROUND OF INVENTION

Apparatus for automatically applying an insert to a web running a high speed and for correlating each insert to a particular printed page area is known. The most relevant prior art is believed to be U.S. Pat. No. 3,083,009. After studying the apparatus of the type disclosed in said patent, we have noted several basic deficiencies. The apparatus in said patent was designed for one size card in the direction of web travel and therefore there is no simple adjustability to accomodate different size cards. If there is a jam-up of cards being fed to the suction applicator roll, there is no means for quickly relieving the jam-up in the apparatus disclosed in said patent. Those problems and others are solved by the present invention.

SUMMARY OF THE INVENTION

The present invention is directed to apparatus for applying an insert to a predetermined portion of a page on a moving web. The apparatus includes a frame means supporting an applicator drum for sequentially applying insert cards to the moving web. A means is provided at a particular location adjacent the applicator drum for bursting a perforation line so as to delineate a discrete card from the remainder of the strip of cards. An assembly is moveable as a unit relative to the frame means toward and away from the applicator drum. The assembly includes a feed roll for feeding the web in the form of a strip of connected cards to the applicator drum. The assembly also includes a burst wheel spaced from said location such as a nip wheel contact point by a distance corresponding to the length of the card and a motor for driving the feed roll. A preferred embodiment, the assembly also includes means for applying at least one line of adhesive to cards while on the feed roll as well as means for adjusting the position of guides for guiding the strip of cards being processed.

It is an object of the present invention to provide a versatile insert apparatus capable of accomodating cards or the like of different length and width.

It is another object of the present invention to provide a card insert apparatus with the ability to rapidly relieve any jam-up of cards being fed through guides to the applicator drum.

Other objects and advantages will appear hereinafter.

For the purpose of illustrating the invention, there is shown in the drawings a form which is presently preferred; it being understood, however that this invention is not limited to the precise arrangements and instrumentalities shown.

FIG. 3 is a partial perspective view of a strip of interconnected cards.

FIG. 6 is a sectional view taken along the line 6—6 in FIG. 5.

FIG. 7 is an enlarged portion of the upper left corner of the movable assembly shown in FIG. 1.

FIG. 8 is an enlarged sectional view taken along the line 8—8 in FIG. 7.

DETAILED DESCRIPTION

Figure 1:
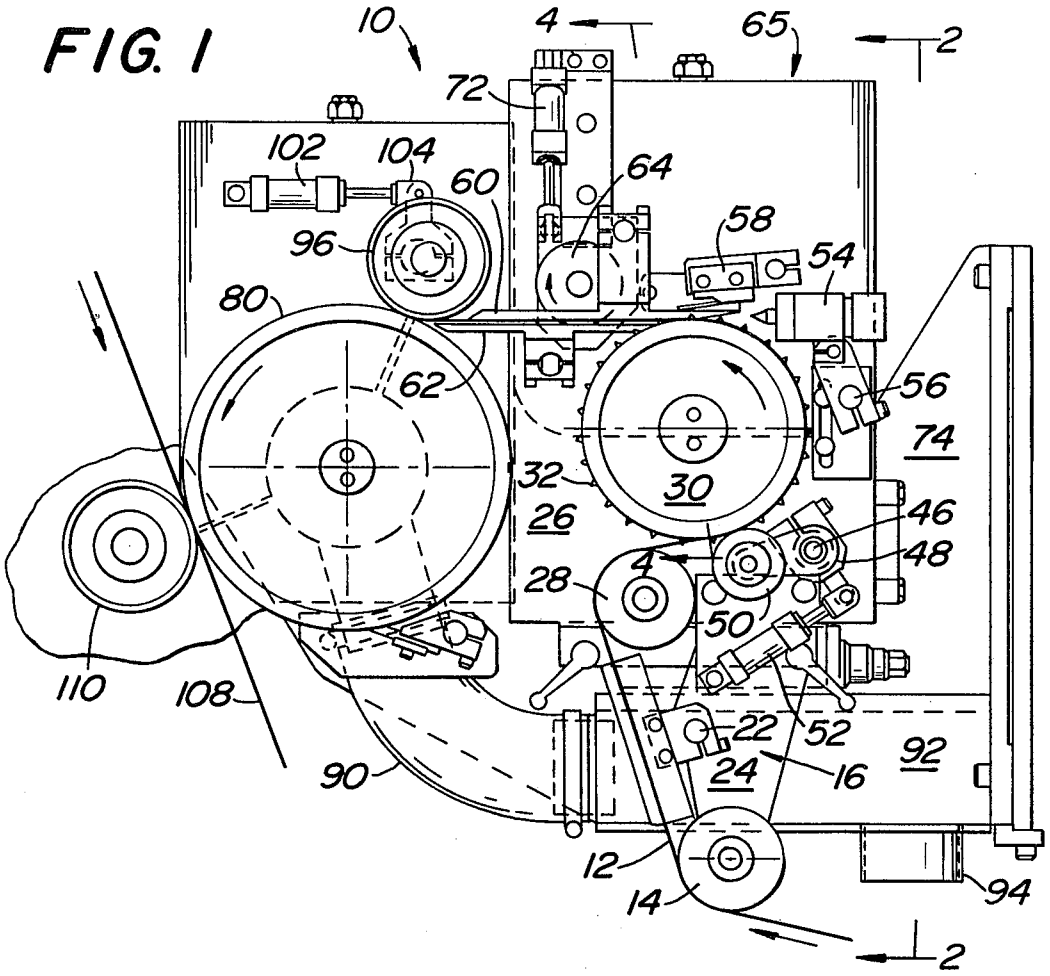
FIG. 1 is a front elevation view of apparatus in accordance with the present invention.

Referring to the drawings in detail, wherein like numerals indicate like elements, there is shown in FIG. 1 a front elevation view of apparatus in accordance with the present invention designated generally as 10. Apparatus 10 is designed to affix pre-printed cards, inserts, coupons, samples, booklets, etc to the margin or some other predetermined location on preprinted pages of a moving web at high speeds such as up to 80,000 cards per hour.

Figure 2:
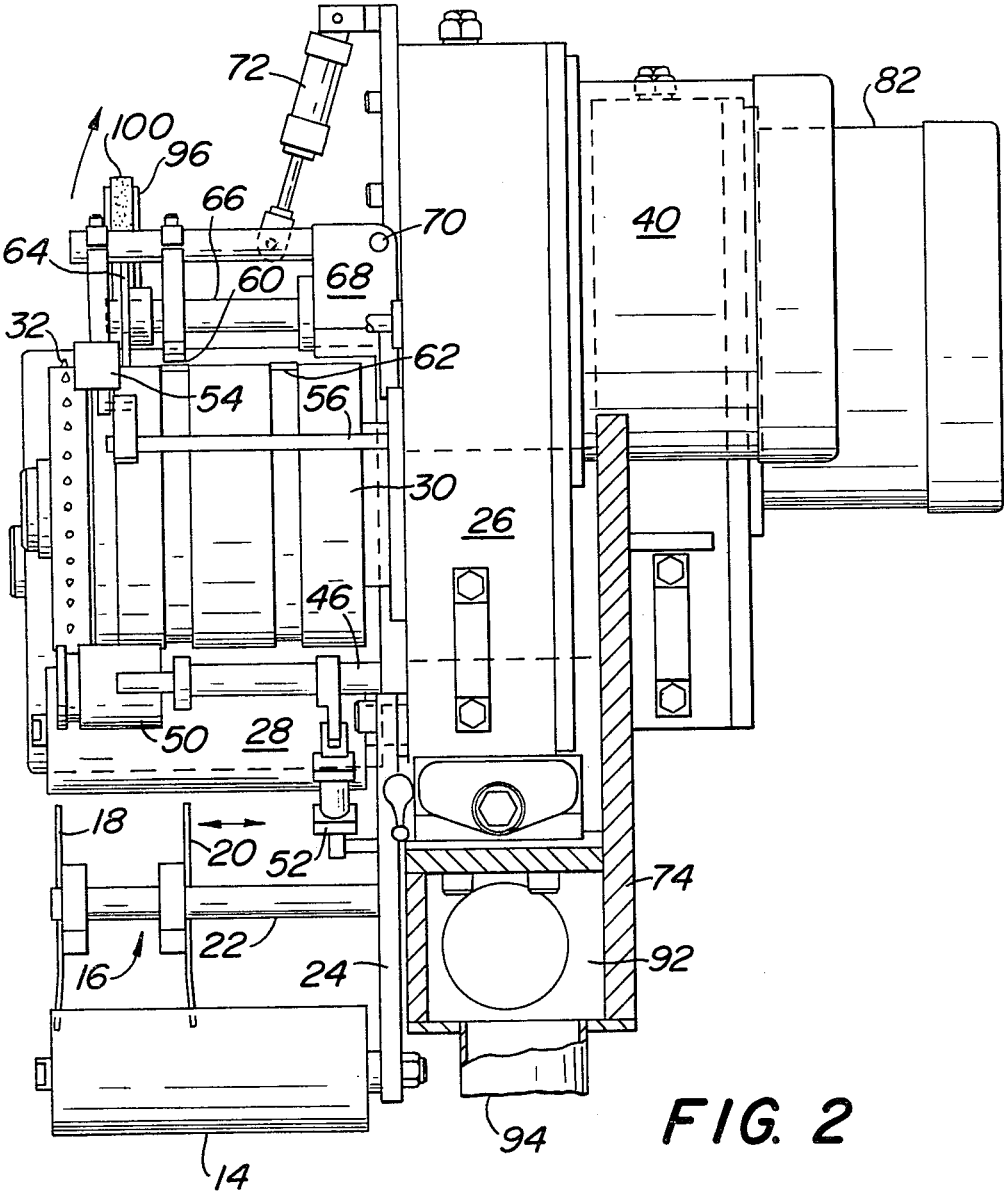
FIG. 2 is a sectional view taken along line 2—2 in FIG. 1.

A strip 12 of pre-printed interconnected cards are withdrawn from a source and extend around idler roller 14 to edge guide means 16. The edge guide means 16 includes a fixed side plate 18 and a moveable side plate 20. The plates 18, 20 are mounted on a common shaft 22. See FIG. 2. Idler roller 14 and shaft 22 are supported by a vertically disposed plate 24. As shown in FIGS. 1 and 2, the upper end of plate 24 is removably bolted to a side face of a gear box 26.

From the edge guide means 16, the strip 12 extends upwardly around an idler roller 28. Idler roller 28 is also supported by the side face of the gear box 26. From the idler roller 28, the strip 12 extends around a feed roll 30. Feed roll 30 is supported by the side face of the gear box 26.

The feed roll 30 has radially disposed fixed pins 32. One advantage of fixed pins 32 is simplicity as well as no maintenance, such as lubrication. The pins 32 are adapted to be received within the row of holes 34 on the strip 12. See FIG. 3. The cards 36 on strip 12 are separable from one another along the transversely disposed perforation lines 38.

Figure 4:
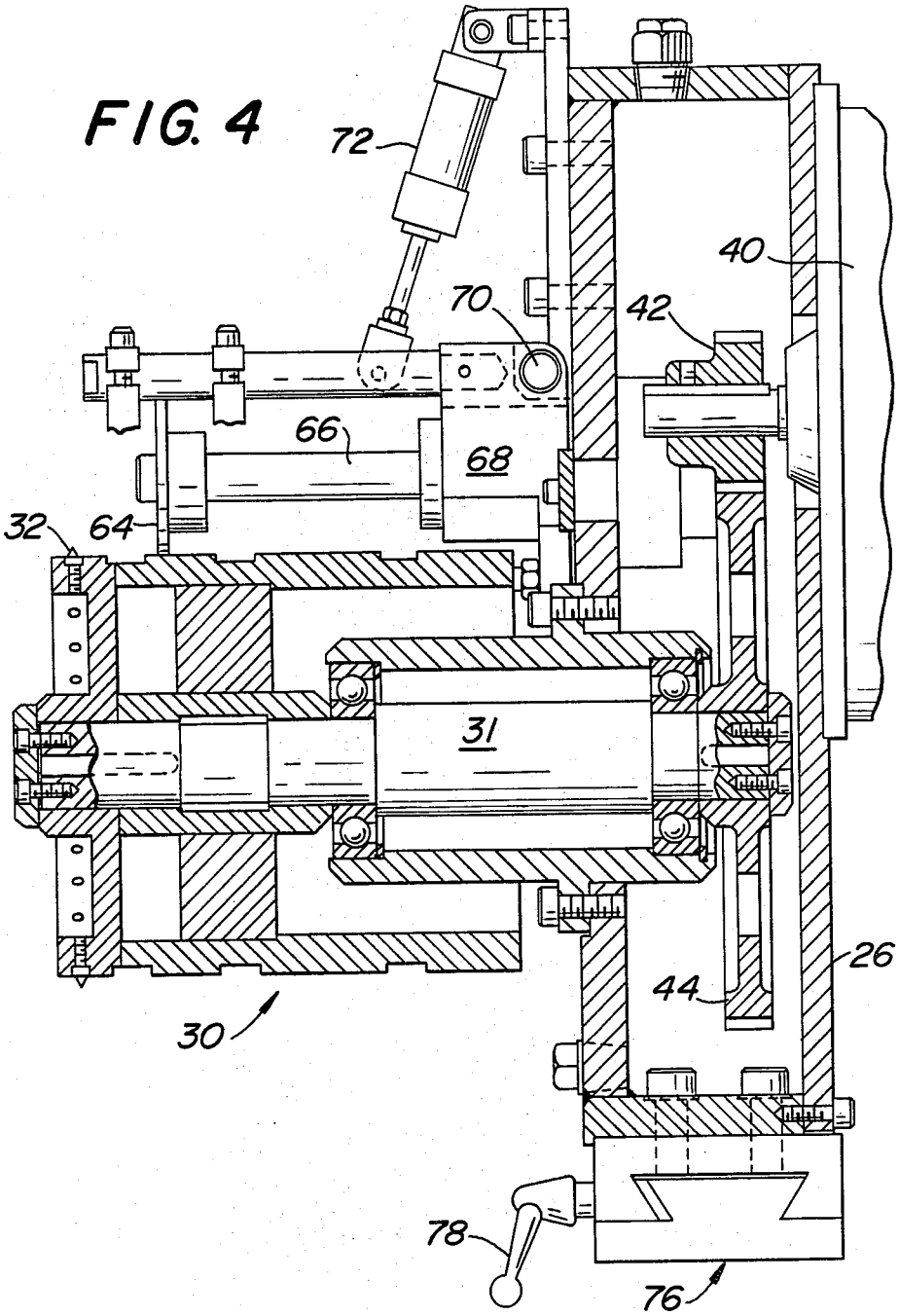
FIG. 4 is a sectional view taken along the line 4—4 in FIG. 1.
Figure 5:
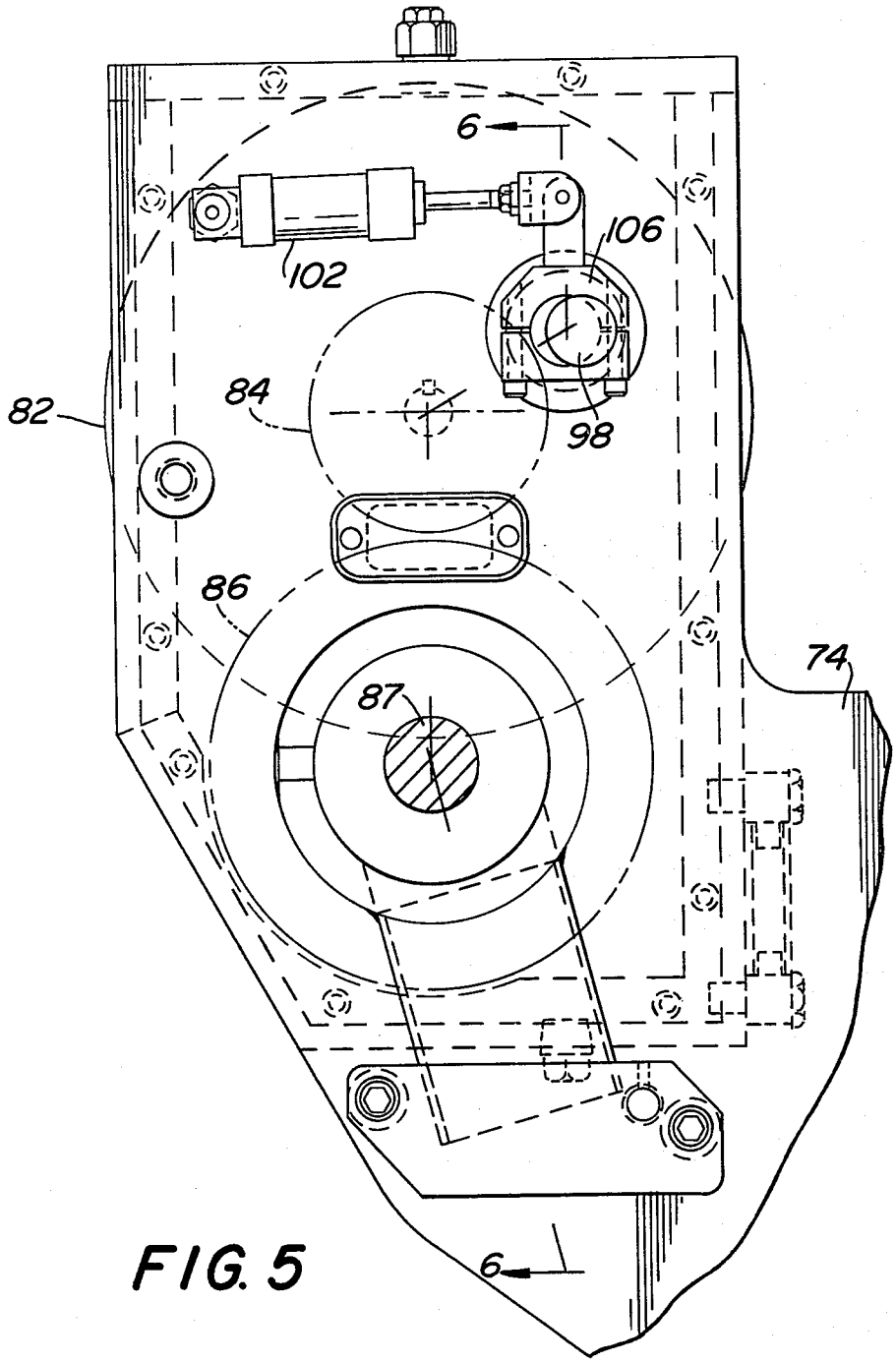
FIG. 5 is an enlarged elevation view of the left-hand end of FIG. 1 with the nip roller and applicator drum removed for purposes of illustration.

Referring to FIG. 4, the feed roll 30 is provided with a centrally disposed shaft 31 rotatably supported by appropriate bearings and mounting bracket on the side face of the gear box 26. The shaft 31 is connected to a gear 44. Gear 44 is meshed with a gear 42 supported within the gear box 26. Gear 42 is coupled to the output shaft at a motor 40 which in turn is supported by the gear box 26. Motor 40 is preferably an electrical motor. As the feed roll 30 rotates about the longitudinal axis of shaft 31, the feed roll 30 feeds the strip 12 in the direction of rotation as shown in FIG. 1.

A shaft 46 is supported by the side face of gear box 26. See FIGS. 1 and 2. A bracket arm 48 extends radially from the shaft 46 and is fixedly secured thereto. Bracket arm 48 rotatably supports a grooved pressure roller 50 for pressing the strip 12 against the outer periphery of the feed roll 30. Shaft 46 may be rotated about its longitudinal axis by cylinder 52. One end of cylinder 52 is pivotably mounted on the plate 24. The other end of cylinder 52 has a piston rod connected by way of a clevice to the shaft 46.

A shaft 56 is supported by side face of the gear box 26. A glue or adhesive dispenser 54 is coupled to shaft 56 by way of a bracket for adjustment along the length of shaft 56. The adhesive applicator is designed to apply a hot melt adhesive in the form of at least one stripe along the edge of the cards 36 while the cards 36 are being fed by the feed roll 30. Adhesive is preferably applied through an adjustable nozzle controlled by way of an air cylinder so that adhesive is dispensed only when the feed roll 30 is driven. A time delay in the feed roll drive insures that a minimum number of cards without adhesive may be processed. The amount of adhesive dispensed is adjustable by way of a variable speed electric drive. The source of adhesive, controls associated therewith, and hoses which connect to the applicator 54 are conventional and not shown.

Adjacent the adhesive dispenser 54, there is provided a jam switch 58 which senses a jam-up of cards and stops the operation of dispenser 54 as well as the rotation of feed roll 30. A break detector, not shown, is provided for detecting a break in the strip 12 and for accomplishing the same function as the jam switch 58.

The strip 12 is fed by the feed roll 30 between upper guide bars 60 and lower guide bars 62. See FIG. 1. Two of the grooves on feed roll 30 accomodate the bars 62 and the other groove is adapted to receive a no-card detector. The bars 60, 62 are narrower than the cards 36 and spaced from each other so that burst wheel 64 may engage the upper surface of the strip 12 and deflect the same downwardly so as to apply stress at the perforation lines 38 between adjacent cards 36. The wheel 64 is supported by a shaft 66. Shaft 66 is rotatably supported by a mounting bracket 68. Bracket 68 is pivotably connected to the gear box 26 for pivotable movement about the axis of pin 70. The axis of pin 70 is perpendicular to the axis of shaft 66. Bracket 68 also supports the upper guide bars 60. The lower guide bars 62 are supported by the gear box 26.

A cylinder 72 as shown more clearly in FIGS. 1 and 2 is pivotably connected at its upper end to a bracket on the gear box 26. The lower end of the cylinder 72 has a piston rod connected by way of a clevice to the bracket 68. Cylinder 72 is operated manually by way of a valve to pivot upper guide bars 60 and burst wheel 64 about the axis of pin 78 to clear any jams which occur.

An assembly designated as 65 is adjustable horizontally in FIG. 1 with respect to a main frame 74. As shown more clearly in FIG. 4, the bottom end of the gear box 26 is connected to the frame 74 by way of a dovetail slide 76. Locking handles 78 are provided. The assembly 65 includes elements 14–60 and 64–72. The purpose for horizontal adjustment of the assembly 65 relative to the frame 74 will be made clear hereinafter.

An applicator drum 80 is supported by the frame 74 to the left of the assembly 65 in FIG. 1. Drum 80 is preferably a suction drum whose surface speed matches the speed of the press web. The outer shell of drum 80 is perforated as shown more clearly in FIG. 6 and rotates around a stationary baffle assembly defined by the two radial vanes indicated in phantom in FIG. 1. The drum 80 is connected to a centrally disposed shaft 87 rotatably supported by the frame 74. One end of shaft 87 is connected to a gear 86. Gear 86 is connected to gear 84 within the gear housing 88. Gear 84 is connected to a drive motor 82 which preferably is electric and supported by the housing 88. As drum 80 rotates, counterclockwise in FIG. 1, only that portion from about the one o'clock position to the nine o'clock position shown in FIG. 1 is evacuated by way of the drum 80, the perforated hollow housing for the shaft 87, and the duct 90. Duct 90 is connected to a suction housing 92 for connection by way of conduit 94 to a blower not shown.

A nip roll 96 is rotatably mounted on shaft 98 which in turn is supported by the frame 74. Roll 96 has a rubber or other elastimeric tire 100. The tire 100 is tangent to the applicator drum 80 at about the one o'clock position. The location of tangency between roll 96 and drum 80 should be spaced from the lowest point on the periphery of burst wheel 64 by a distance corresponding to the length of the cards 36. If the length of the cards 36 changes, assembly 65 is appropriately changed to accomodate the different length of cards and the speed of motor 40 is appropriately changed. One embodiment of the apparatus of the present invention is designed so that the cards may vary in length from about $5\frac{1}{4}$ to 7" and have a width of between 3 and 7". Cards 36 should never be wider than their length and preferably are paper having the minimum thickness of 0.005" and a maximum thickness of 0.010". The cards 36 should be of sufficient weight and stiffness as is conventional.

Nip roll 96 is moveable toward and away from the periphery of drum 80 by means of a cylinder 102. Cylinder 102 is supported by the frame 74. The piston rod associated with cylinder 102 is connected by way of a clevice 104 to arm 106. The arm 106 is connected to an eccentric portion on the shaft 98. See FIG. 6. As shaft 98 is rotated by arm 106, roll 96 moves toward and away from the periphery of the drum 80.

The cards 36 are applied by way of the adhesive stripe to the printed pages of a web 108. Web 108 passes between the applicator drum 80 at about the nine o'clock position in FIG. 1 and is pressed there against by way of a trolley or pressure roll 110.

The burst wheel 64 is a driven wheel and yet is supported by the bracket 68 for pivotable movement about the pivot pin 70. In order that this may be accomplished, reference is made to FIGS. 7 and 8. It will be noted that the shaft 66 supporting the burst friction drive 118 having a conical surface for mating with the cone 116.

The drive 118 is connected to a shaft 120 rotatably supported within the housing 126 by way of bearings 122, 124. Housing 126 is bolted to the gear box 26. A gear 128 on the shaft 120 meshes with the gear 44. A threaded limit stop 130 is provided on the bracket 68 for adjusting the shaft 66 for exact parallelism. Frictional contact between elements 116 and 118 is adjusted by axial adjustment of shaft 66 using the locking nut of bearing 112. The gear boxes 26 and 88 are generally filled with oil. Gear box 88 is stationary while gear box 26 forms the major component of the assembly 65 and supports various components which are moveable therewith as described above. The ratio of gear 128 to gear 44 is such that the surface speed of burst wheel 64 is faster than the surface speed of roll 30.

DESCRIPTION OF OPERATION

The feed roll 30 withdraws the strip 12 from its supply container and causes the same to pass between the plates 18 and 20. Plates 18 and 20 have been previously adjusted to accomodate the particular width of the cards 36 on the strip 12. The pulling and feeding of strip 12 is attained by the cooperation between pins 32 and the holes 34. The strip 12 is fed to the applicator drum 80. The assembly 65 has previously been adjusted so that the distance between the tangent point of nip roll 96 with applicator drum 80 and the lowest point on the periphery of burst wheel 64 corresponds to the length of the cards 36.

As the strip of cards 36 passes the nozzle on adhesive dispenser 54, a stripe of adhesive is applied. Roll 30 is driven by its motor 40 while drum 80 is driven by its motor 82. Also, burst wheel 64 is driven by motor 40. Nip roll 96 is biased into contact with the roll 84 by cylinder 102 and is driven by contact therewith. As the leading edge of a card 36 enters the nip between roll 96 and drum 80, the high speed of the drum 80 applies a rapid pulse of tension in the card 36. At the same time, burst wheel 64 induces a high stress at the first perforation line 38 upstream from nip roll 96 thereby causing the perforation line to separate or burst. The separated card 36 accelerates to the speed of web 108 and is held by the suction on drum 80 until the adhesive stripe contacts the web 108 and is pressed onto the web 108 as it passes between trolley 110 and drum 80. Motor 82 drives the surface of drum 80 at press web speed. Motor 40 drives the feed roll 30 at the exact speed needed to feed one card 36 per page of the web 108. Other alternatives are available such as two cards per page, one card every other page, etc. When the length of the cards 36 changes, due to a changeover from one run to another, assembly 65 must be adjusted toward or away from the nip between roll 96 and drum 80. If a jam occurs at the guide bars 60, 62, cylinder 72 is activated to raise the bracket 68 by pivoting about the axis of pin 70. Pivoting of bracket 68 raises the guide bars 60 and burst wheel 64, interrupts the drive to the burst wheel 64 and facilitates access to the area of jammed cards.

The present invention may be embodied in other specific forms without departing from the spirit or essential attributes thereof and, accordingly, reference should be made to the appended claims, rather than to the foregoing specification, as indicating the scope of the invention.

We claim:

1. Card insert apparatus comprising a frame means, an applicator drum rotatably mounted on said frame means for sequentially applying cards to a moving web, means at a location adjacent said applicator drum for bursting a strip of cards into individual cards, an assembly moveable as a unit relative to said frame means tangentially toward and away from said applicator drum whereby the insert apparatus is adjustable to accept different length cards, said assembly including a common support for:

a. a feed roll for feeding a web in the form of a strip of connected cards to said applicator drum;

b. said bursting means including a burst roll spaced from a point on said applicator drum by a distance corresponding to the length of a card being processed and also spaced from said feed roll; and c. a motor for driving said feed roll and means for driving said burst roll.

2. Apparatus in accordance with claim 1 including an upper web guide assembly between said feed roll and said applicator drum, means for enabling said web guide and said burst roll to move as a unit to an inoperative position for clearing a card jam.

3. Apparatus in accordance with claim 1 including edge guide plates supported by said assembly for movement therewith, said edge guide plates being supported for adjustment toward and away from each other so as to accomodate different width cards.

4. Apparatus in accordance with claim 1 wherein said assembly includes an adhesive dispenser for dispensing at least one stripe of adhesive on cards as the cards are in contact with said feed roll.

5. Apparatus in accordance with claim 1 including means for enabling said motor driving said feed roll to also drive said burst roll but at a higher surface speed.

6. Card insert apparatus comprising a frame means, an applicator drum supported by said frame means for sequentially applying cards to a moving web, an assembly moveable as a unit on a common support relative to said frame means toward and away from said applicator drum, said assembly including a feed roll having pins for entry into apertures along one edge of a strip of interconnected cards for feeding the strip of cards to a nip between said applicator drum and a nip roll supported by said frame means, a burst wheel for separating a strip of cards into individual cards, said burst wheel being mounted on and forming a portion of said assembly and spaced from said feed roll, an electric motor forming a portion of said assembly for driving said feed roll and burst wheel, means on said assembly for moving the burst wheel to permit clearing of a card jam, the assembly being moveable to permit adjustment of the distance between said nip and a lowermost point on said burst wheel to correspond to the length of cards being processed.

7. Apparatus in accordance with claim 6 wherein said burst wheel and feed roll are cantilevered on said common support.

8. Apparatus in accordance with claim 7 wherein said common support is a gear box, said feed roll being on one side of said gear box and said motor being on an opposite side of said gear box.

* * * * *